United States Patent [19]

Soileau

[11] 4,092,564

[45] May 30, 1978

[54] DISCHARGE LAMP OPERATING CIRCUIT

[75] Inventor: Trasimond A. Soileau, Flat Rock, N.C.

[73] Assignee: General Electric Company, New York, N.Y.

[21] Appl. No.: 750,749

[22] Filed: Dec. 15, 1976

Related U.S. Application Data

[63] Continuation-in-part of Ser. No. 692,080, Jun. 2, 1976, Pat. No. 4,069,442.

[51] Int. Cl.[2] ..... H05B 41/231

[52] U.S. Cl. ..... 315/208; 315/242; 315/244; 315/283; 315/200 R; 315/290; 315/DIG. 7

[58] Field of Search ..... 315/200 R, 205, 208, 315/209 R, 240, 241 R, 242, 244, 283, 289, 290, DIG. 7; 361/13

[56] References Cited

U.S. PATENT DOCUMENTS

| | | | |
|---|---|---|---|
| 3,953,723 | 4/1976 | Herrick | 315/DIG. 7 |
| 3,969,652 | 7/1976 | Herzog | 315/290 |
| 4,045,709 | 8/1977 | Morais | 315/290 X |
| 4,045,710 | 8/1977 | Neal | 315/205 |

*Primary Examiner*—Eugene R. LaRoche
*Attorney, Agent, or Firm*—Sidney Greenberg

[57] ABSTRACT

Circuit operating from a direct current source applies DC pulses to a high pressure sodium vapor lamp to improve the color properties of the lamp. In one embodiment, the circuit includes a charging circuit comprising a first inductor, a diode and a capacitor connected across the DC source, and a discharging circuit comprising a second inductor of lower inductance than the first inductor, a controlled thyristor switch and sodium vapor lamp connected across the capacitor, and a timing circuit for periodically turning on the switch at predetermined intervals. A third inductor and a serially connected diode are connected across the discharging circuit to prevent excessive voltage across the controlled switch and to provide for control of lamp wattage with respect to changes in lamp voltage.

15 Claims, 4 Drawing Figures

DISCHARGE LAMP OPERATING CIRCUIT

This is a continuation-in-part of application Ser. No. 692,080 filed June 2, 1976, now U.S. Pat. No. 4,069,442.

The present invention relates to operating circuits for gaseous discharge lamps, and more particularly concerns direct current operating circuits for high pressure sodium vapor discharge lamps.

The present invention concerns an improvement in the circuits disclosed in co-pending applications of Soileau, Ser. No. 692,080 and Morais, Ser. No. 692,078, now U.S. Pat. No. 4,045,709 issued Aug. 30, 1977, both applications filed June 2, 1976, and Neal, Ser. No. 743,566, filed Nov. 22, 1976, all assigned to the same assignee as the present invention.

A related type of circuit is disclosed in co-pending application Ser. No. 729,041 filed Oct. 4, 1976, now U.S. Pat. No. 4,048,543 issued Sept. 13, 1977, and assigned to the same assignee as the present invention.

It is a general object of the invention to provide an improved DC operating circuit for pulsed operation of loads.

It is particular object of the invention to provide an improved DC operating circuit for applying DC pulses to gaseous discharge lamps, especially of high pressure sodium vapor type, to produce improved color properties of the lamp light output.

It is another object of the invention to provide a circuit of the above type which is simple in construction, efficient and reliable in operation, and relatively low in cost.

It is still another object of the invention to provide a circuit of the above type for controlling lamp wattage in respect to changes of lamp voltage.

Other objects and advantages will become apparent from the following description and the appended claims.

With the above objects in view, the present invention in one of its aspects relates to a lamp operating circuit comprising a DC power source, a charging capacitor, a first inductor in series with the charging capacitor connected across the DC power source and forming therewith a charging circuit for charging the capacitor, a second inductor connected across the charging capacitor and forming therewith a discharging circuit for discharging the capacitor, a controlled switch in series with one of the inductors, the latter inductor having a substantially smaller inductance than the other inductor, control means coupled to the controlled switch for repetitively operating the same at predetermined intervals, a gaseous discharge lamp connected in series in one of the charging and discharging circuits, and unidirectional circuit means connected across the series connected one inductor and controlled switch for limiting the voltage across the controlled switch.

Specifically, the unidirectional circuit means comprises a diode and an induction coil connected in series In one embodiment, the controlled switch and the smaller inductor are in the charging circuit, whereas in another embodiment these components are in the discharging circuit.

In a typical embodiment of the invention, the lamp is of high pressure sodium vapor type, and the controlled switch is a silicon controlled rectifier.

A related type of circuit is disclosed in co-pending application Ser. No. 729,041 — Owen et al, filed Oct. 4, 1976, and assigned to the same assignee as the present invention.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900 — Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The circuit of the present invention is also useful for operating discharge lamps containing mixed metal vapors such as the above described lamp or other lamps in a manner to avoid color separation therein, in accordance with the method and principles disclosed in co-pending application Ser. No. 701,333 — Owen, filed June 30, 1976 and assigned to the same assignee as the present invention. The disclosure thereof in the said Owen application is accordingly also incorporated herein by reference.

The invention will be better understood from the following description taken in conjunction with the accompanying drawings, in which.

Figure 1:
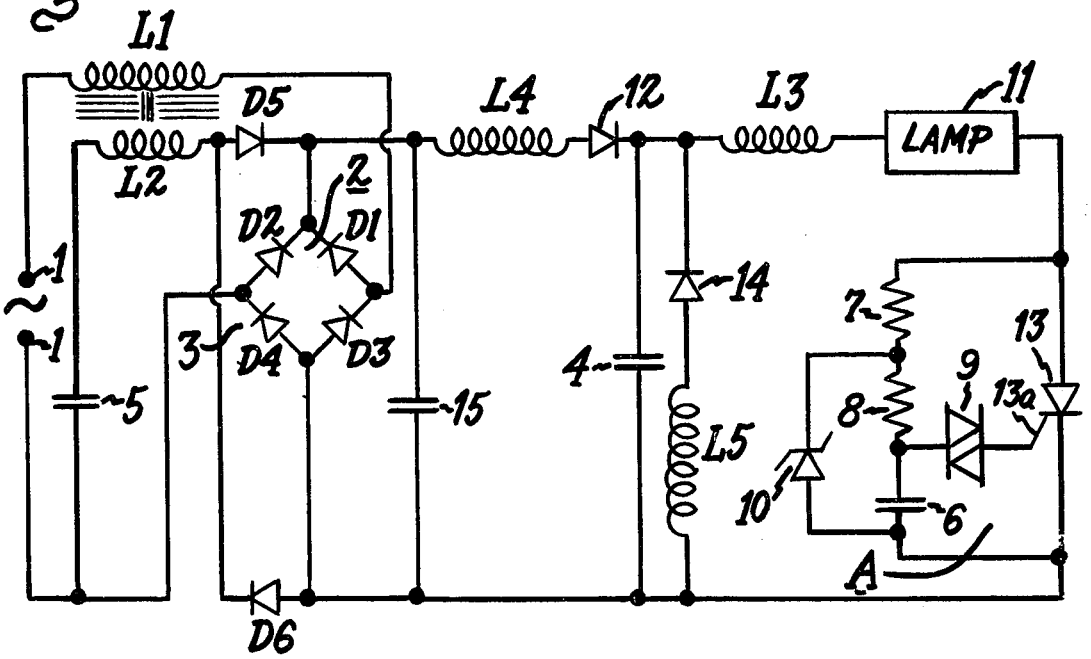
FIG. 1 is a circuit diagram of a DC pulse operating circuit in accordance with an embodiment of the invention.

Referring now to the drawings, and particularly to FIG. 1, there is shown a circuit diagram of a typical embodiment of the invention comprising terminals 1 of a source of alternating current, and induction coil L1 connected at one side to one of the source terminals and at the other side to an input terminal of full wave bridge rectifier 2, which comprises diodes D1, D2, D3 and D4 arranged in conventional manner as shown, the other input terminal of bridge rectifier 2 being connected to the other source terminal 1. Auxiliary induction coil L2 is inductively coupled to main induction coil L1, such as by arrangement of the two coils on a common magnetic core on opposite sides of a magnetic shunt. Such an arrangement of inductively coupled coils is shown, for example, in the U.S. Pat. to Willis No. 3,873,910, issued Mar. 25, 1975 and assigned to the same assignee as the present invention, and the disclosure thereof is accordingly incorporated herein by reference. Auxiliary induction coil L2 is connected at opposite sides respectively to the input terminals of another full wave bridge rectifier 3 constituted by diodes D5 and D6 co-acting with diodes D2 and D4 to provide full wave rectification of the current from auxiliary coil L2. Capacitor 5 connected between auxiliary coil L2 and the input terminal of bridge rectifier 3 is selected such that in conjunction with the leakage reactance existing between induction coils L1 and L2, it serves to provide the necessary phase shift and power factor. If induction coil L2 and capacitor 5 are selected so that the portion of the magnetic core associated with coil L2 is saturated, a higher degree of lamp wattage regulation is achieved for a wide range of input voltage.

Connected across the thus described DC supply circuit to the common output terminals of bridge rectifiers 2 and 3 is a lamp pulsing circuit including gaseous discharge lamp 11, particularly of high pressure sodium vapor type, as described above.

By virtue of the described DC supply circuit, the direct current supplied to lamp 11 by main induction coil L1 via bridge rectifier 2 is substantially out of phase with the direct current supplied to the lamp by auxiliary coil L2 and capacitor 5 via bridge rectifier 3. As a result, the average current through the lamp and the voltage across the lamp is substantially increased over the average magnitude of current and voltage which would be applied in the absence of auxiliary coil L2 and its associated rectifier circuit, and therefore the tendency of the lamp to drop out because of de-ionization at current zero is largely prevented, and at the same time a sufficiently high re-ignition voltage is thereby provided to maintain operation of the lamp. In the operation of the circuit, main induction coil L1 also serves as a current limiting reactance to limit current flowing through the lamp after it starts and thereby provides a ballasting function.

A DC supply circuit of the above described type is disclosed in co-pending application Ser. No. 608,531 — Neal, filed Aug. 28, 1975 now U.S. Pat. No. 4,045,708 issued Aug. 30, 1977, and assigned to the same assignee as the present invention, and the disclosure of that application is accordingly incorporated herein by reference.

In the embodiment of the present invention illustrated in FIG. 1, filter capacitor 15 connected across the DC supply circuit provides a filtered DC voltage supply for the pulse generating circuit described hereinafter and increases the average voltage supplied thereto. The type of pulse generating circuit shown in FIG. 1 for pulsed operation of the lamp is disclosed in the above-mentioned co-pending Neal application Ser. No. 743,566 and the disclosure thereof is accordingly incorporated herein by reference.

As disclosed in the latter Neal application, a charging circuit comprising serially connected inductor L4, diode 12 and capacitor 4 is connected across filter capacitor 15, and a discharging circuit comprising serially connected inductor L3, lamp 11 and controlled unidirectional thyristor switch, such as silicon controlled rectifier (SCR) 13, is connected across capacitor 4.

The inductance of inductor L4 is substantially higher than that of inductor L3, and in a typical circuit for practicing the invention the L4 inductance would be about 10 times that of L3. However, the ratio may be in the range of about 2:1 to about 50:1 or higher while still obtaining satisfactory results. In general, the L4 inductance should be sufficiently high to ensure proper discharging of capacitor 4 through the discharge circuit and to provide for sufficient reversal of the capacitor charge to commutate the SCR as described below.

The operation of SCR switch 13 is controlled by a timing and triggering circuit A including an RC timing circuit comprising, in the illustrated embodiment, capacitor 6 and resistors 7 and 8 connected across the SCR. A voltage breakdown device 9 constituted by a diac in the circuit shown is connected at one side to the junction of capacitor 6 and resistor 8 and at the other side to the control electrode (gate) 13*a* of SCR switch 13. Zener diode 10 is connected across capacitor 6 and resistor 8 of the timing circuit.

A starting aid circuit (not shown) may be incorporated in the described circuit for initially applying sufficiently high voltage pulses to lamp 11 for starting. Such a starting circuit and the above-described control circuit A are disclosed in the aforementioned co-pending Morais application, and the disclosures thereof in the latter application are accordingly incorporated herein by reference.

Briefly, the operation of the RC timing circuit shown in FIG. 1 is such that capacitor 6 is charged at a rate determined by the combination of resistors 7, 8 and capacitor 6. When the potential on capacitor 6 reaches the breakdown voltage of diac 9, capacitor 6 discharges through the loop including SCR control electrode 3*a* and turns on SCR 3. While a diac is shown as the voltage breakdown device 9, other breakdown devices such as silicon bilateral switch (SBS), a Shockley diode, a glow tube, or a series combination of certain of these devices, could be employed.

Zener diode 10 connected to the junction of resistors 7 and 8 of the RC timing circuit stabilizes the timing of the triggering operation by establishing a fixed clamping voltage toward which capacitor 6 is charged.

In accordance with the present invention, a feedback branch comprising series-connected diode 14 and inductor L5 is connected across the described discharging circuit comprising serially connected inductor L3, lamp 11 and SCR 13. The provision of this feedback branch serves to limit the peak voltage across SCR 13 and thereby avoids undesirable firing of the SCR and affords desirable control of the lamp watts-lamp volts relationship as explained more fully below.

In the operation of the described circuit, capacitor 4, which serves as an energy metering device in the circuit, is initially charged by current flowing from filter capacitor 15 through inductor L4 and diode 12. The charge on capacitor 4 reaches a positive voltage substantially higher than the supply voltage. When SCR 13 is triggered on by operation of the RC timing circuit, capacitor 4 discharges through inductor L3, lamp 11 and SCR 13, and subsequently this energy (minus the amount dissipated in the lamp) is returned to capacitor 4 but with the polarity of the voltage reversed, such that the upper electrode of capacitor 4 goes to a negative potential. This voltage reversal causes the SCR cathode voltage to be more positive than its anode voltage, and as a result commutation and turn-off of the SCR switch occurs. This negative potential is prevented from reversing again by SCR 13. Capacitor 4 is then again charged by supply current flowing through inductor L4 and diode 12, and through inductor L5 and diode 14 as hereinafter described, to a voltage higher than the supply voltage, and diode 12 serves to prevent the recharged energy on capacitor 4 from returning to the supply source. The circuit remains quiescent until the next pulse is provided by operation of the RC timing circuit. The latter circuit is adjusted to trigger SCR 13 to produce pulses of desired repetition rate for pulsing lamp 11 in the manner intended.

On subsequent cycles, the positive voltage drop across SCR 13 increases to even higher levels, until an equilibrium potential is reached as a function of the total resistive losses in the circuit. This equilibrium potential can assume values greater than twice the supply voltage. In an illustrative case, with a supply voltage of about 180 volts, the equilibrium voltage across SCR 13 typically reaches about 450 volts during operation. Such high voltages, when imposed across lamp 11 during conduction of SCR 13, serve to ensure re-ionization and continued operation of the lamp, especially when the pulse repetition rate is relatively low.

The provision of the above-described feedback branch in accordance with the invention serves to limit the peak voltage across SCR 13 during the lamp starting interval when the lamp voltage is low, and thereby avoids undesirable firing of the SCR during this period due to excessive anode voltage, especially if it is of low voltage capability.

Such inadvertent firing not only may cause degradation of the SCR but also may result in higher peak currents through lamp 11, causing higher lamp wattage and consequent shorter lamp life. The feedback branch functions (see FIG. 1) to transfer energy from the cathode side of SCR 13 to the power source side of the discharge circuit combination of inductor L3 and SCR 13. As a result, the voltage across the SCR prior to switching on of the latter is limited to an acceptable maximum level.

Figure 2:
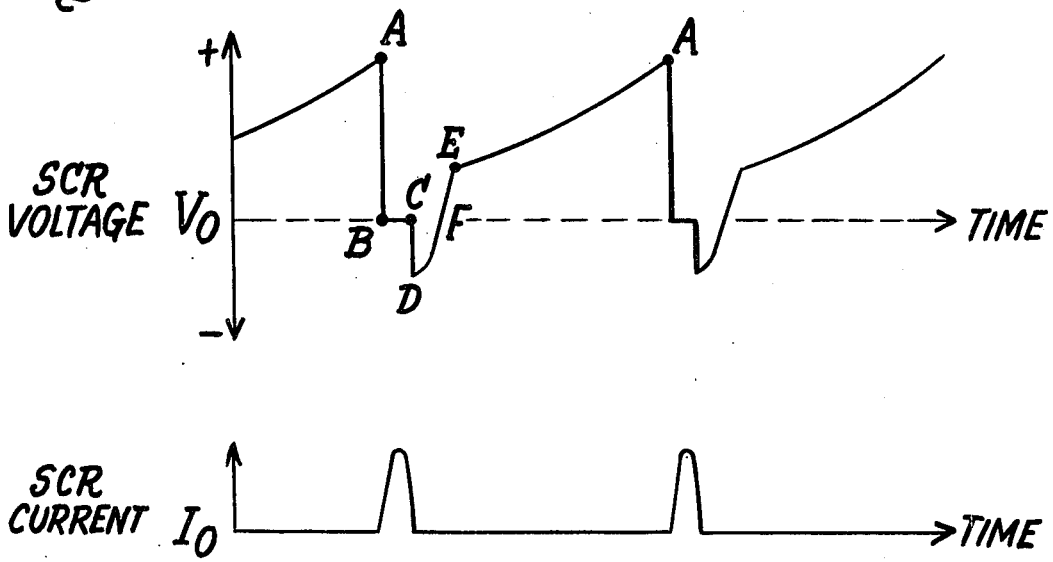
FIG. 2 is a graphical representation of the voltage and current waveforms relating to the operation of the circuit shown in FIG. 1.

FIG. 2 graphically shows the SCR voltage and current pulse waveforms achieved after equilibrium is reached in the operation of the described circuit. The initial positive SCR voltage drop shown (anode positive with respect to cathode) prevails before the SCR is gated on. When the SCR switch is turned on at point A, as determined by the RC timing circuit, the voltage across the switch immediately drops to zero, as indicated at point B. The voltage remains zero while the current flows through the SCR switch. During this period, as seen in the SCR current waveform, the current rises to a peak value and then drops to zero due to operation of the LC circuit comprising inductor L4 and capacitor 4. The reversal of current is prevented by the SCR, and due to the large negative voltage (with respect to ground) on capacitor 4 as described previously, the SCR is reverse biased to achieve commutation. As the SCR ceases to conduct, as indicated at point C, the voltage drop across the SCR is reversed, i.e., assumes a negative polarity with its cathode voltage more positive than its anode voltage, as indicated at point D. Capacitor 4 then charges through inductor L4 and diode 12, as well as through feedback branch L5 — diode 14. The RC timing circuit starts timing interval when the SCR voltage goes positive (point F) so that the interval from F to A is determined by the timing circuit.

The described dual charging operation produces the portion of the SCR voltage waveform from D to E as the SCR anode potential is made positive by the resulting reversal of charge on capacitor 4. At point E, capacitor 4 continues to be charged only through inductor L4 and diode 12, producing a more gradual charging rate represented by the waveform portion from E to A, and at point A the SCR anode potential is at its maximum.

Figure 3:
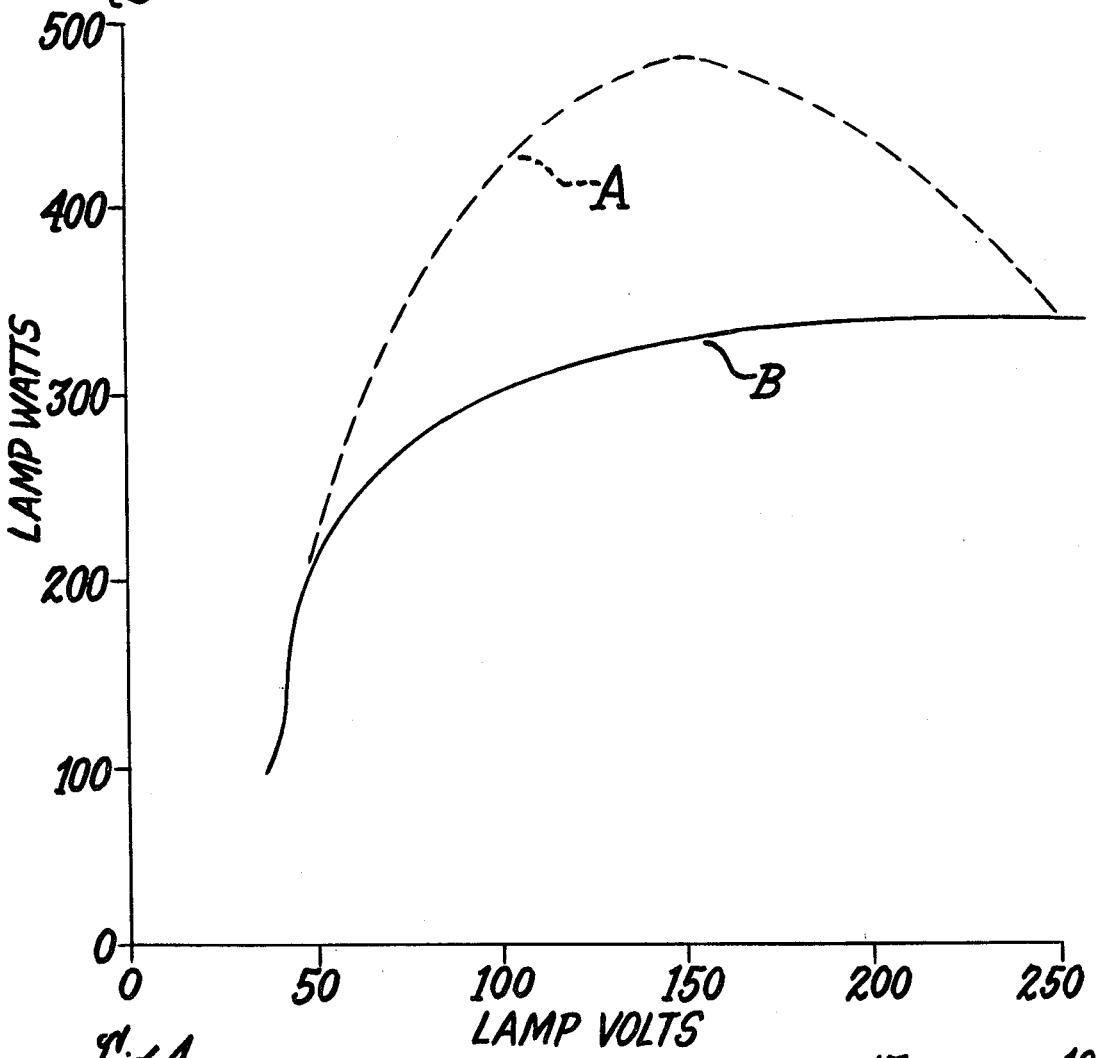
FIG. 3 is a graph showing the relationship of lamp volts and watts characterizing the circuit of the invention.

FIG. 3 graphically illustrates the additional benefit afforded by the described circuit in providing for control of the lamp watts-lamp volts relationship, whereby a flatter curve for this relationship may be obtained. In the graph, Curve A in interrupted lines shows the variation in lamp watts with lamp volts in a circuit without the feedback arrangement of the present invention as described above, while Curve B shows the watts-volts relationship characterizing the circuit of the present invention. In the circuit of Curve A, the increase in lamp volts, which typically occurs over the operating life of lamps such as here involved, is accompanied by a substantial increase in lamp watts, which tends to shorten lamp life due to excessive heating. In contrast, it is evident that Curve B is substantially flatter than Curve A and that accordingly the lamp watts remains relatively constant with increase in lamp volts, resulting in longer life of the lamp and more nearly uniform illumination during its operating life.

Figure 4:
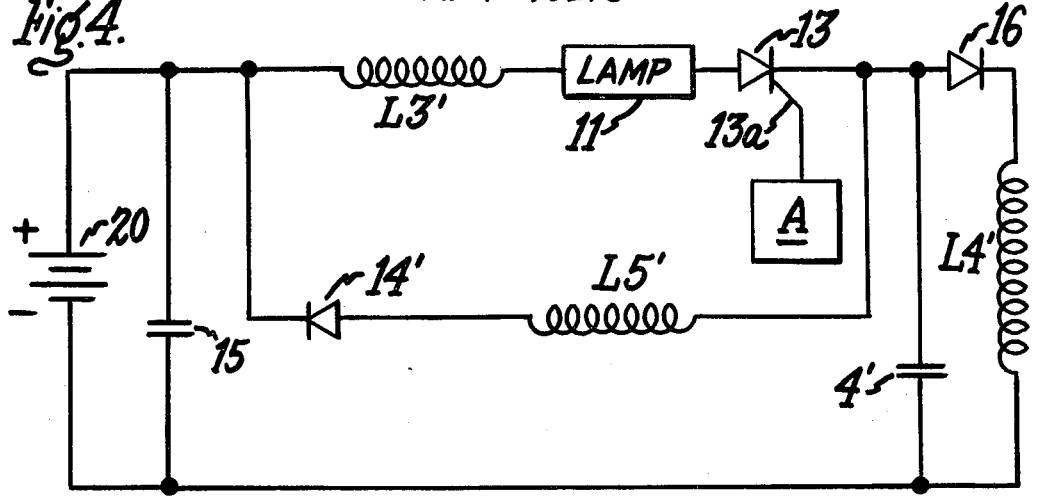
FIG. 4 is a circuit diagram of another embodiment of the invention.

FIG. 4 shows a different embodiment of the invention wherein the charging circuit connected to filter capacitor 15 and DC power source 20 (shown in simplified form) comprises the series combination of SCR 13, smaller inductor L3′ and lamp 11, whereas the discharging circuit connected across metering capacitor 4′ comprises serially connected diode 16 and large inductor L4′. Such a circuit is shown in the aforementioned copending application of Soileau, Ser. No. 692,080 and the disclosure therein of the circuit and manner of operation thereof is accordingly incorporated herein by reference. In this embodiment, as in the FIG. 1 embodiment, the feedback branch comprising inductor L5′ and diode 14′ is connected across the series combination of inductor L3′, lamp 11 and SCR 13 to produce similar results. However, in this case, in reference to the description of the waveforms in FIG. 2, at point D capacitor 4 discharges through diode 16 and inductor L4′, as well as discharging through the feedback branch L5′ — diode 14′. This dual discharging operation produces the portion of the SCR voltage waveform from D to E, and at point E, capacitor 4 continues to discharge only through inductor diode 16 and inductor L4′, producing the waveform portion E to A. This embodiment also provides the desirable lamp watts-lamp volts relationship shown in FIG. 3.

In a typical circuit such as shown in FIG. 1, the following components may have the values indicated:

Inductor L3 — 0.7 millihenries
Inductor L4 — 7 millihenries
Capacitor 4 — 3 microfarads
Capacitor 6 — 5.12 microfarad
Resistor 7 — 41K ohms
Resistor 8 — 7K ohms
Zener diode 10 — 62 volts
Diode 12 — 1K volts
Diac 9 — 38 volts
Inductor L5 — 0.3 millihenries
Diode 14 — >1K volts A snubber circuit of conventional RC type (not shown), if found necessary or desirable, may be connected across diode 12, diode 14 or SCR 13 to reduce voltage spikes across those components.

Lamp 11 may be arranged in various places in either the charging or discharging circuit of either of the FIG. 1 and FIG. 4 embodiments. Such modifications will produce varied but satisfactory results in accordance with the invention.

While an SCR is disclosed as the unidirectional controlled switch in the described circuit, it will be understood that other equivalent switch devices may alternatively be employed in accordance with the invention. For example, a triac or a transistor switch may be employed in combination with a diode to provide unidirectional operation, and as used herein the expression "unidirectional controlled switch means" is intended to include all such equivalent switch devices or arrangements.

The power supply may be any suitable source of DC voltage, such as a battery or a rectified AC source different from that described above. Preferably, the DC supply is at least about 150 volts in order to achieve the desired improvement in color properties of lamp 1 (assuming the lamp to be of 250–300 watt variety).

While a diode has been disclosed in series with the larger inductor L4 (or L4′), the diode may be dispensed with if inductor L4 has sufficiently high inductance.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by letters Patent of the United States is:

1. A lamp operating circuit comprising, in combination, a DC power source, a charging capacitor, a first inductor in series with said charging capacitor connected across said DC power source and forming therewith a charging circuit for charging said capacitor, a second inductor connected across said charging capacitor and forming therewith a discharging circuit for discharging said capacitor, a controlled switch in series with one of said inductors, said one inductor having a substantially smaller inductance than the other inductor, control means coupled to said controlled switch for repetitively operating the same at predetermined intervals, means for connecting a gaseous discharge lame in series in one of said charging and discharging circuits, and unidirectional circuit means comprising a unidirectional conductor and a third inductor in series therewith connected across said serially connected one inductor and controlled switch for limiting the voltage across controlled switch and for controlling lamp wattage with respect to changes in lamp voltage.

2. A circuit as defined in claim 1, the ratio of inductance of said other inductor to said one inductor being at least about 2:1.

3. A circuit as defined in claim 2, wherein said ratio is at least about 10:1.

4. A circuit as defined in claim 1, and a first diode in series with said other inductor.

5. A circuit as defined in claim 4, said unidirectional conductor comprising a second diode and said third inductor comprising an induction coil.

6. A circuit as defined in claim 1, wherein said one inductor is said first inductor.

7. A circuit as defined in claim 1, wherein said one inductor is said second inductor.

8. A circuit as defined in claim 1, including a gaseous discharge lamp connected to said connecting means.

9. A circuit as defined in claim 8, said gaseous discharge lamp being a high pressure sodium vapor lamp.

10. A circuit as defined in claim 8, said gaseous discharge lamp containing mixed metal vapors.

11. A circuit as defined in claim 1, said DC power source comprising input terminals for connection to an AC current source, a first induction coil connected to said input terminals, an auxiliary induction coil inductively coupled to said first induction coil, first rectifier means connected to the output of said first induction coil, and second rectifier means connected to the output of said auxiliary induction coil.

12. A circuit as defined in claim 11, wherein a filter capacitor is connected across said DC power source.

13. A circuit as defined in claim 1, said controlled switch comprising a silicon controlled rectifier.

14. A lamp operating circuit comprising, in combination, a DC power source, a first inductor and a capacitor in series with each other across said power source, a second inductor and unidirectional controlled switch means connected in series across said capacitor, said second inductor having an inductance substantially lower than said first inductor, control means coupled to said unidirectional controlled switch means for repetitively operating the same at predetermined intervals, means for connecting a gaseous discharge lamp in series with said second inductor and said controlled switch means, and branch circuit means comprising a diode and inductance means connected in series across said serially connected second inductor, unidirectional controlled switch means and lamp connecting means for limiting the voltage across said controlled switch means and for controlling lamp wattage with respect to changes in lamp voltage.

15. A lamp operating circuit comprising, in combination, a DC power source, a first inductor, unidirectional controlled switch means and a capacitor connected in series with each other across said power source, a second inductor of substantially higher inductance than said first inductor connected across said capacitor and forming a discharge loop therewith, means for connecting a gaseous discharge lamp across said DC power source in series with said first inductor and said unidirectional controlled switch means, control means coupled to said controlled switch means for repetitively operating the same at predetermined intervals, and branch circuit means comprising a diode and inductance means connected in series across said serially connected first inductor, lamp connecting means and unidirectional controlled switch means for limiting the voltage across said controlled switch means and for controlling lamp wattage with respect to changes in lamp voltage.

* * * * *